US011495891B2

(12) United States Patent
Patotski

(10) Patent No.: US 11,495,891 B2
(45) Date of Patent: Nov. 8, 2022

(54) MICROSTRIP PATCH ANTENNA WITH INCREASED BANDWIDTH

(71) Applicant: Carrier Corporation, Palm Beach Gardens, FL (US)

(72) Inventor: Marat Patotski, Gdansk (PL)

(73) Assignee: CARRIER CORPORATION, Palm Beach Gardens, FL (US)

( * ) Notice: Subject to any disclaimer, the term of this patent is extended or adjusted under 35 U.S.C. 154(b) by 23 days.

(21) Appl. No.: 17/089,955

(22) Filed: Nov. 5, 2020

(65) Prior Publication Data

US 2021/0143557 A1 May 13, 2021

(30) Foreign Application Priority Data

Nov. 8, 2019 (EP) ..... 19208147

(51) Int. Cl.
*H01Q 21/08* (2006.01)
*H01Q 9/04* (2006.01)
*H01Q 21/00* (2006.01)

(52) U.S. Cl.
CPC ..... *H01Q 21/08* (2013.01); *H01Q 9/045* (2013.01); *H01Q 21/0075* (2013.01)

(58) Field of Classification Search
CPC .... H01Q 21/08; H01Q 9/045; H01Q 21/0075; H01Q 19/005; H01Q 1/38; H01Q 21/065; H01Q 1/50; H01Q 21/0006
See application file for complete search history.

(56) References Cited

U.S. PATENT DOCUMENTS 4,812,855 A 3/1989 Coe et al.
5,220,335 A * 6/1993 Huang ..... H01Q 1/38 343/834

(Continued)

FOREIGN PATENT DOCUMENTS

EP 0391634 A1 10/1990
EP 0753897 A2 1/1997

(Continued)

OTHER PUBLICATIONS

European Search Report for Application No. 19208147.9; dated May 15, 2020; 10 Pages.

(Continued)

*Primary Examiner* — David E Lotter
(74) *Attorney, Agent, or Firm* — Cantor Colburn LLP

(57) ABSTRACT

A microstrip antenna array including: a thin substrate; two or more microstrip radiating patches placed on a first side of the substrate, each radiating patch including: an input port; a radiating patch width (WRP) extending in a longitudinal direction; a radiating patch length (LRP) extending in a transverse direction, wherein the transverse direction is perpendicular to the longitudinal direction, and wherein the longitudinal and transverse directions are in the plane of the radiating patch; a radiating patch transverse axis (TRP) along the midpoint of the radiating patch width; and a radiating patch longitudinal axis along the midpoint of the radiating patch length, wherein the two or more radiating patches are spaced in the longitudinal direction such that the radiating patch longitudinal axis of each radiating patch is aligned along a common longitudinal axis (C); and one or more parasitic patches placed on the first side of the substrate.

14 Claims, 8 Drawing Sheets

(56) References Cited

U.S. PATENT DOCUMENTS

| | | | | |
|---|---|---|---|---|
| 5,576,718 | A * | 11/1996 | Buralli | H01Q 21/065 343/700 MS |
| 5,680,144 | A | 10/1997 | Sanad | |
| 5,955,994 | A * | 9/1999 | Staker | H01Q 19/005 343/700 MS |
| 6,133,882 | A | 10/2000 | Lafleur et al. | |
| 6,211,854 | B1 | 4/2001 | Fujiyoshi | |
| 6,999,030 | B1 | 2/2006 | Mateychuk | |
| 7,068,234 | B2 | 6/2006 | Sievenpiper | |
| 7,099,686 | B2 | 8/2006 | Ro et al. | |
| 7,221,322 | B1 | 5/2007 | Durham et al. | |
| 7,408,520 | B2 | 8/2008 | Durham et al. | |
| 7,420,519 | B2 | 9/2008 | Durham et al. | |
| 7,973,734 | B2 | 7/2011 | Strempel et al. | |
| 8,466,844 | B2 | 6/2013 | Ying | |
| 9,755,311 | B2 | 9/2017 | Zhou et al. | |
| 9,941,596 | B2 | 4/2018 | Zhang et al. | |
| 10,186,778 | B2 | 1/2019 | Zemliakov | |
| 10,476,149 | B1 * | 11/2019 | Ueda | H01Q 21/08 |
| 2008/0088510 | A1 * | 4/2008 | Murata | H01Q 3/24 343/876 |
| 2009/0278746 | A1 * | 11/2009 | Aurinsalo | H01Q 9/0435 343/700 MS |
| 2011/0260925 | A1 | 10/2011 | Chirila | |
| 2013/0169503 | A1 * | 7/2013 | Fakharzadeh Jahromi | H01Q 19/005 343/833 |
| 2015/0236408 | A1 * | 8/2015 | Kona | H01Q 21/22 343/750 |
| 2018/0123245 | A1 | 5/2018 | Toda et al. | |
| 2019/0067834 | A1 * | 2/2019 | Park | H01Q 5/385 |

FOREIGN PATENT DOCUMENTS

| | | | |
|---|---|---|---|
| EP | 0817310 | B1 | 9/2003 |
| EP | 0886336 | B1 | 10/2003 |
| EP | 1481440 | B1 | 9/2006 |
| EP | 1093675 | B1 | 7/2007 |
| EP | 1436857 | B1 | 1/2008 |
| EP | 1608037 | B1 | 10/2008 |
| EP | 2826097 | B1 | 4/2017 |
| EP | 3010086 | B1 | 11/2017 |
| JP | 2009089217 | A | 4/2009 |
| WO | 2017150054 | A1 | 11/2018 |

OTHER PUBLICATIONS

Korisch, I.A.; "Antenna Beamwidth Control Using Parasitic Subarrays", Antennas and Proagation for Wireless Communications; 200 lEEE-Aps Conference, Nov. 6-8, 2000, Piscataway, NJ, USA. 4 Pages.

European Examination Report for Application No. 19208147.9; dated Feb. 4, 2022; 9 Pages.

* cited by examiner

Mutual coupling S21-parameters: a) —— Prior art antenna array; – Proposed antenna array #1; c) ----- Proposed antenna array #2; d) -·-·- Proposed antenna array #3

Voltage Standing Wave Ratio (VSWR) at the input of a microstrip patch or for: a) —— Prior art antenna array; b) ---- Proposed antenna array #1; c) ----- Proposed antenna array #2; d) -·-·- Proposed antenna array #3

Gain of the active patch for a) φ=0 deg; b) φ=90 deg, where:

—— Prior art antenna array; – – – Proposed antenna array #1;

----- Proposed antenna array #2; ------ Proposed antenna array #3

MICROSTRIP PATCH ANTENNA WITH INCREASED BANDWIDTH

FOREIGN PRIORITY

This application claims priority to European Patent Application No. 19208147.9, filed Nov. 8, 2019, and all the benefits accruing therefrom under 35 U.S.C. § 119, the contents of which in its entirety are herein incorporated by reference.

TECHNICAL FIELD OF INVENTION

The present disclosure relates to microwave antennas, particularly to microstrip patch antenna arrays.

BACKGROUND OF THE INVENTION

High frequency radio transmission and microwave transmission, particularly in the 1 to 10 GHz range, is of great importance to high-speed data transmissions having low power consumption. Additionally, the increasing density of components on printed circuit boards (PCBs) calls for advances that reduce the size of individual components on the PCB to facilitate further component density increases.

Microstrip patch antennas are becoming increasingly useful as they can be printed directly onto a circuit board and their low profile and small size suits them particularly to applications where parameters such as space and weight is at a premium. Existing patch antennas are typically low cost and are easily fabricated.

SUMMARY OF THE INVENTION

Viewed from a first aspect, the invention provides a microstrip antenna array comprising: a thin substrate; two or more microstrip radiating patches placed on a first side of the substrate, each radiating patch comprising: an input port; a radiating patch width extending in a longitudinal direction; a radiating patch length extending in a transverse direction, wherein the transverse direction is perpendicular to the longitudinal direction, and wherein the longitudinal and transverse directions are in the plane of the radiating patch; a radiating patch transverse axis along the midpoint of the radiating patch width; and a radiating patch longitudinal axis along the midpoint of the radiating patch length, wherein the two or more radiating patches are spaced in the longitudinal direction such that the radiating patch longitudinal axis of each radiating patch is aligned along a common longitudinal axis; and one or more parasitic patches placed on the first side of the substrate, wherein there is at least one fewer parasitic patches than there are radiating patches, each parasitic patch comprising: a parasitic patch width extending in the longitudinal direction; a parasitic patch length extending in the transverse direction; a parasitic patch transverse axis along the midpoint of the parasitic patch width; and a parasitic patch longitudinal axis along the midpoint of the parasitic patch length, wherein the one or more parasitic patches are spaced in the longitudinal direction such that the parasitic patch longitudinal axis of each parasitic patch is aligned along the common longitudinal axis, wherein each parasitic patch is positioned between two radiating patches, and wherein the parasitic patch transverse axis of each parasitic patch is positioned at the midpoint between the radiating patch transverse axes of the two radiating patches either side of each parasitic patch.

An advantage of the first aspect is to increase the bandwidth of the patch antenna array by around 50% or more, depending on the particular materials and construction of the patch used. Also, the use of a thin substrate has an advantage of increased structural flexibility and reduced manufacturing costs.

A microstrip is a type of transmission line that may be used for the transmission of microwave, terahertz, or high frequency radio waves. Microstrip structures may be fabricated on printed circuit board (PCB) or as part of monolithic microwave integrated circuits (MMICs) using conventional methods known to the skilled person. Such methods include, but are not limited to, milling, screen printing, and chemical etching. Thus, the microstrip patch antenna may be formed on a PCB by one of those techniques.

A substrate may be considered to be "thin" when the substrate is significantly smaller in thickness in comparison to the wavelength of the frequency of the antenna on the substrate, specifically in relation to the wavelength of the antenna in the dielectric substrate $\lambda_d$. This wavelength is modified from the wavelength of the signal in free space $\lambda_0$ by the relative dielectric constant of the substrate material $\varepsilon_r$, where $\lambda_d \propto \varepsilon_r^{-1/2}$. Thus, media with higher dielectric constants would result in a shorter signal wavelength in the dielectric. The thin substrate may comprise a single layer of substrate material, where the material may have a thickness of around 1.0 mm or less, such as 0.5 mm, 0.2 mm or 0.1 mm. Substrate materials such as Duroid, Teflon or FR4 may be suitable for thin film patch antennas. Thin substrates may be more flexible than thicker single layer substrates or multilayer substrates. The use of a thin substrate for a patch antenna array may allow the array to be formed around rounded objects or fit into spaces that would otherwise be difficult for arrays using thicker substrates to conform to.

Microstrip structures may be formed on the conducting layer of a PCB, which is the layer of conducting material on top of the PCB substrate. The conducting layer may be relatively thin compared to the thickness of the substrate. The shape of a microstrip structure may be two-dimensional in the plane of the conducting layer and the structure may be formed by etching or milling the conducting layer of a PCB to remove unwanted conducting material. Each microstrip structure in the conducting plane may have a uniform thickness.

The ground layer is on the opposite side of the substrate to the conducting layer. The ground layer may be uniform in thickness and may be formed from the same material as the conducting layer. The ground layer may be defectless or may have defects formed in its surface. The ground layer may cover all of the substrate on the side on which it is placed.

A parasitic element or passive radiator is a conductive element which is not electrically connected to any other component. In other words, parasitic components do not have an input port and are not driven directly.

The microwave patch antenna comprises at least two radiating patches formed on a substrate. The structure as a whole, including the two or more radiating patches, may collectively be referred to as an "array". The radiating patches may be formed in single row on a substrate. Each radiating patch may be oriented in the same direction on the same substrate. Each radiating patch may be equally spaced along the common longitudinal axis in the longitudinal direction of the substrate. Each radiating patch may be regularly spaced along the common longitudinal axis such that the radiating transverse axis of each adjacent radiating patch is equidistance from one another. The distance between two adjacent radiating patches may be about $0.5\lambda_o$, or may be in the range of $0.25\lambda_o$ to $0.75\lambda_o$. Alternatively, the distance between two radiating patches in an array of more than two radiating patches may not be regular.

Each radiating patch may have equal dimensions, that is, the radiating patch widths and the radiating patch lengths of each radiating patch are the same. Alternatively, radiating patches may have radiating patch widths and/or radiating patch lengths that differ between individual radiating patches or subsets of patches.

A parasitic patch may be conducting material formed into a single contiguous patch in the plane of the radiating patches. Alternatively, the term "parasitic patch" may refer to a structure comprising a number of components. That is, a parasitic patch may comprise a strip of conducting material on the substrate and one or more VIAs, wherein a VIA is an electrical connection between the conducting metal on one side of the substrate and the ground plane on the other side of the substrate and may be a through hole where the edges of the hole are coated in a conducting material. Alternatively again, a parasitic patch may refer to a structure comprising two or more strips of conducting material formed on the substrate in the plane of the radiating patches.

One or more VIAs may be placed along the parasitic patch longitudinal axis and divide the conducting metal portion of the parasitic patch into two quarter wavelength $\lambda_d/4$ resonant portions. The quarter wavelength $\lambda_d/4$ portions may be coupled together through the one or more VIAs. This coupling may create an additional resonance frequency $f_3$. In the case of two or more VIAs, the distance between VIAs and the diameters of the VIAs is tuned to provide necessary coupling between two quarter wavelength $\lambda_d/4$ resonance portions. VIAs may be positioned to form resonant portions of other lengths.

As another alternative, the parasitic patch may comprise two or more parasitic microstrip lines are placed between the radiating patches. That is, the parasitic patch may comprise two or more microstrip lines formed in the transverse direction. The transverse microstrip lines may be parallel and they may be of equal width. The length of the two or more parasitic microstrip lines may be around a half wavelength of the signal in substrate $\lambda_d/2$ at the central working frequency $f_0$. The gaps between parasitic microstrip lines and radiating patches $G_P$ may be tuned to provide a certain strength of coupling k between radiating patches. The parasitic microstrip lines may be coupled together through the gap $G_{PML}$. This coupling may create an additional resonance frequency $f_3$. The gap between parasitic microstrip lines $G_{PML}$ may be tuned to provide necessary coupling between them. This coupling may be such that ripples in the single response are minimized.

The parasitic patch structure may have a total parasitic patch width and a total parasitic patch length, wherein these dimensions may encompass all components in a parasitic patch in the conducting plane. These total lengths may include additional features of the parasitic patch, such as VIAs, or may cover the extent of a patch that is formed from more than one parasitic microstrip line. The parasitic patch may not be in physical contact with any of the radiating patches in the conducting plane.

At least one of the one or more parasitic patches may be symmetric about the common longitudinal axis.

At least one of the one or more parasitic patches may be symmetric about its parasitic patch transverse axis.

At least one of the two or more radiating patches may be symmetric about its radiating patch transverse axis.

The microstrip array of the first aspect may use a microstrip feed, which is the excitation of the microstrip antenna by a microstrip line on the same conducting layer. A microwave patch antenna may alternatively be fed in a number of other non-limiting ways, such as: directly at the end of the patch; using an inset feed; using a quarter-wave impedance matching transmission line; from underneath using a coaxial cable or probe feed; using coupled feeds; or using aperture feeds. The particular type of feed may be dependent upon the particular application of the patch antenna, and is not limited to those mentioned here. Any feedline may be connected to the input port of the radiating patches. Each input port may have a separate feed. Alternatively, multiple input ports may have a common feed. In some example embodiments there may be a common feeding network connected to input ports of multiple radiating patches. For example, two adjacent radiating patches with a parasitic patch between them may be united by a common feeding network, hence forming them into one interconnected structure with the common feeding network connecting the two input ports.

BRIEF DESCRIPTION OF THE DRAWINGS

Certain embodiments of the disclosure will now be described by way of example only and with reference to the accompanying drawings in which.

DETAILED DESCRIPTION OF THE INVENTION

Figure 1A:
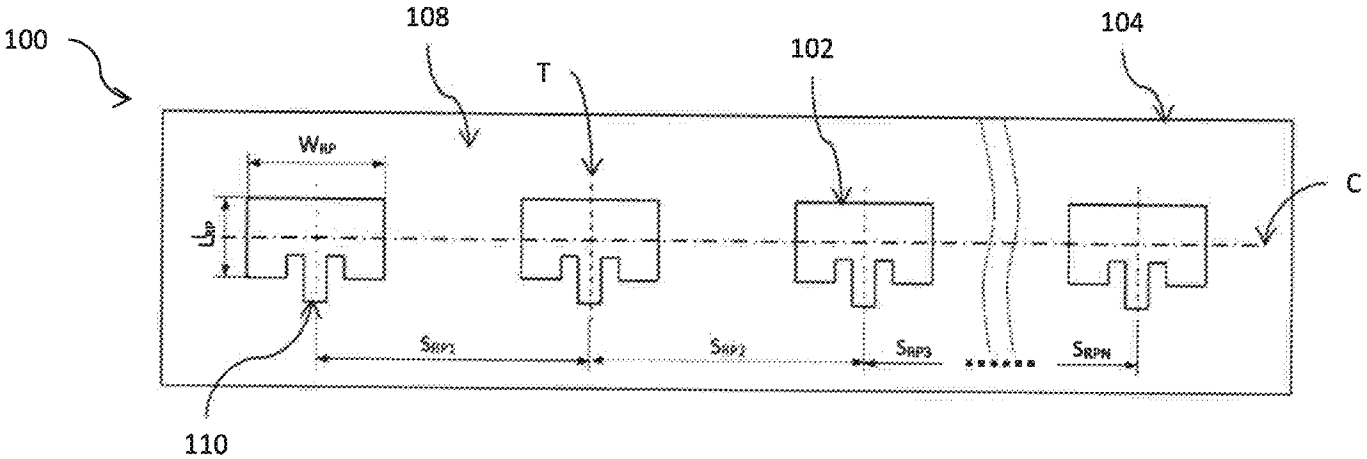
FIG. 1A is a top view of a prior art microstrip antenna array.
Figure 1B:
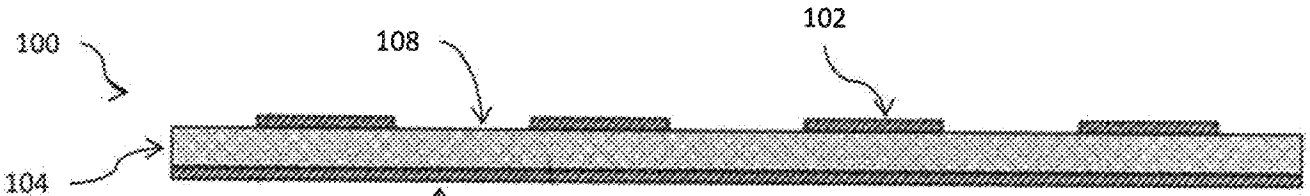
FIG. 1B is a side view of a prior art microstrip antenna array.

A prior art patch antenna array 100 is presented in FIGS. 1A and 1B, where FIG. 1A shows a top view of the array 100 to display an arrangement of radiating patches 102 and FIG. 1B shows a side view of the array 100. The prior art patch antenna array 100 comprises a substrate 104 formed from a single layer of substrate material, a layer of conducting material forming a ground layer 106 on the bottom side of the substrate 104, and a plurality of radiating patches 102 on a top side 108 of the substrate 104. Each radiating patch 102 has an input port 110, a radiating patch width $W_{RP}$ extending in a longitudinal direction, and a radiating patch length $L_{RP}$ extending in a transverse direction. The each of the plurality of radiating patches 102 are spaced along a common longitudinal axis C and are oriented so that the input ports 110 for each of the radiating patches 102 are oriented in the same direction.

Each radiating patch 102 also comprises a radiating patch transverse axis T along the midpoint of the radiating patch width $W_{RP}$. Starting from the leftmost radiating patch in FIG. 1A and moving rightwards, the radiating patches 102 may be labelled RP1, RP2 . . . RPN, for N number of radiating patches 102. The distance between the transverse axes T of two adjacent patches 102, starting from the distance between RP1 and RP2 and moving rightwards may then be labelled $S_{RP1}$, $S_{RP2}$ . . . $S_{RP(N-1)}$.

The mutual coupling between patches 102 is characterized either by the conductance matrix (G-matrix) or by the scattering matrix (S-matrix).

The mutual conductance between two rectangular microstrip patches for the radiating patch arrangement is [1]:

$$G_{12} = \frac{2}{\pi} \cdot \sqrt{\frac{\varepsilon}{\mu}} \cdot \int_0^{\pi} \left[ \frac{\sin\left(\frac{k_0 W}{2} \cdot \cos\theta\right)}{\cos\theta} \right]^2 \sin^3\theta \cdot \cos\left(\frac{Z}{\lambda_0} 2\pi \cdot \cos\theta\right) \left[1 + J_0\left(\frac{L}{\lambda_0} 2\pi \sin\theta\right)\right] d\theta$$

$J_0$—the Bessel function of the first kind of order zero;

Z—the center-to-center separation between the patches and equal to the array step $S_{RP}$.

W—the width of the radiating patch;

L—the length of the radiating patch;

$\lambda_0$—is the wavelength in free space;

ε—the permittivity of free space;

μ—the permeability of free space.

In the prior art array 100 shown in FIGS. 1A and 1B, the fields in the space between the elements are primarily transverse electric (TE) modes and there is not a strong dominant mode surface wave excitation. Therefore, there is reduced coupling between the elements. When the coupling is small, the resonant frequency of the patch radiator is close to the resonant frequency of uncoupled antennas $f_0$.

When the strength of coupling increases, two resonant frequencies $f_1$ and $f_2$ of coupled patches appear. The strength of coupling is described with the coupling coefficient k that can be computed from the following formula:

$$k = \frac{f_2^2 - f_1^2}{f_2^2 + f_1^2}$$

$f_1$—the lower resonant frequency of coupled antennas;

$f_2$—the upper resonant frequency of coupled antennas.

To improve the coupling between radiating patches a parasitic patch is used. Placing a resonance structure (the parasitic patch) between active radiating patches increases coupling between the radiating patches and provides mutual detuning of radiators. Active radiating patches are radiating patches that are being fed with a signal via the input port of the radiating patch.

Figure 2A:
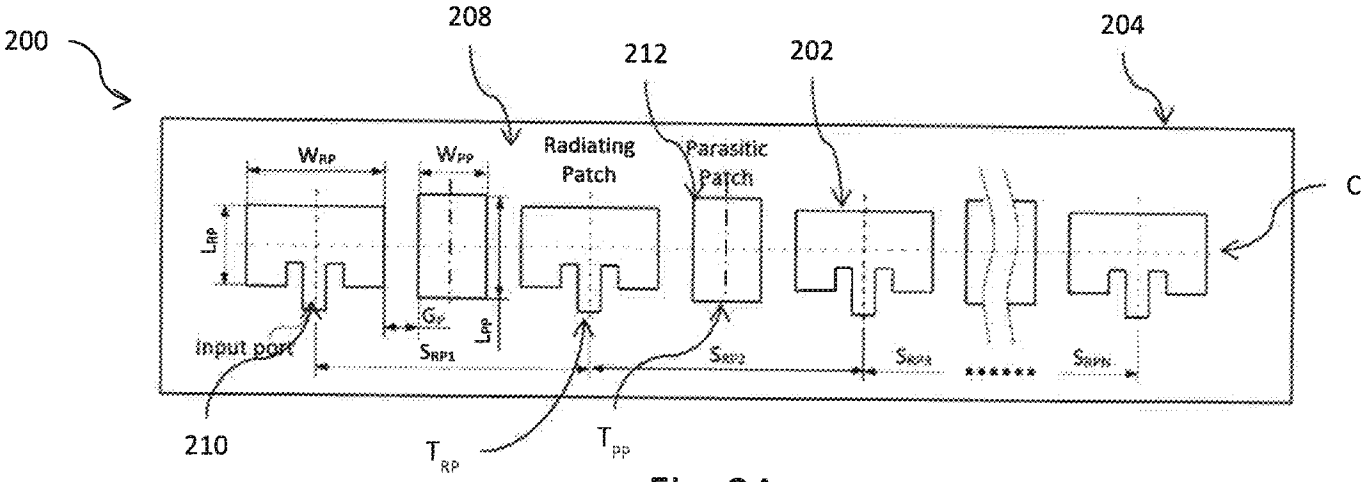
FIG. 2A is a top view of an example microstrip antenna array.
Figure 2B:
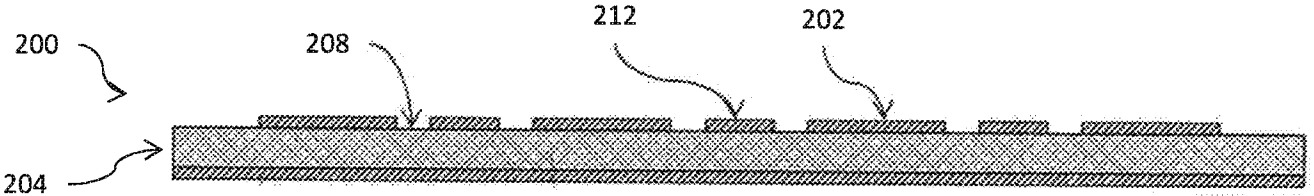
FIG. 2B is a side view of an example microstrip antenna array.

One example of a microstrip patch antenna array 200 having parasitic patches is shown in FIGS. 2A and 2B. The microstrip antenna array 200 comprises a thin substrate 204 and two or more microstrip radiating patches 202 placed on a first side 208 of the substrate 204. Each radiating patch 202 comprises an input port 210, a radiating patch width $W_{RP}$ extending in a longitudinal direction, and a radiating patch length $L_{RP}$ extending in a transverse direction, wherein the transverse direction is perpendicular to the longitudinal direction, and wherein the longitudinal and transverse directions are in the plane of the radiating patch 202. Each patch 202 also comprises a radiating patch transverse axis $T_{RP}$ along the midpoint of the radiating patch width $W_{RP}$ and a radiating patch longitudinal axis along the midpoint of the radiating patch length. The two or more radiating patches 202 are spaced in the longitudinal direction such that the radiating patch longitudinal axis of each radiating patch 202 is aligned along a common longitudinal axis C.

The microstrip patch array 200 also comprises one or more parasitic patches 212 placed on the first side 208 of the substrate 204, wherein there are at least one fewer parasitic patches 212 than there are radiating patches 202. Each parasitic patch 212 comprises a parasitic patch width $W_{PP}$ extending in the longitudinal direction, a parasitic patch length $L_{PP}$ extending in the transverse direction, a parasitic patch transverse axis $T_{PP}$ along the midpoint of the parasitic patch width, and a parasitic patch longitudinal axis along the midpoint of the parasitic patch length. The one or more parasitic patches 212 are spaced in the longitudinal direction such that the parasitic patch longitudinal axis of each parasitic patch 212 is aligned along the common longitudinal axis C.

Each parasitic patch 212 is positioned between two radiating patches 202 and the parasitic patch transverse axis $T_{PP}$ of each parasitic patch is positioned at the midpoint between the radiating patch transverse axes $T_{RP}$ of the two radiating patches 202 either side of each parasitic patch 212.

The parasitic patch 212 has such dimensions so that to provide necessary coupling k between radiating patches 202. The length of parasitic patch $L_{PP}$ is approximately close to a half wavelength in substrate $\lambda_d$ at a central working frequency $f_0$. The parasitic patch width $W_{PP}$ and gaps between radiating patches $G_P$ are tuned to provide the certain strength of coupling k between radiating patches 202.

Figure 3A:
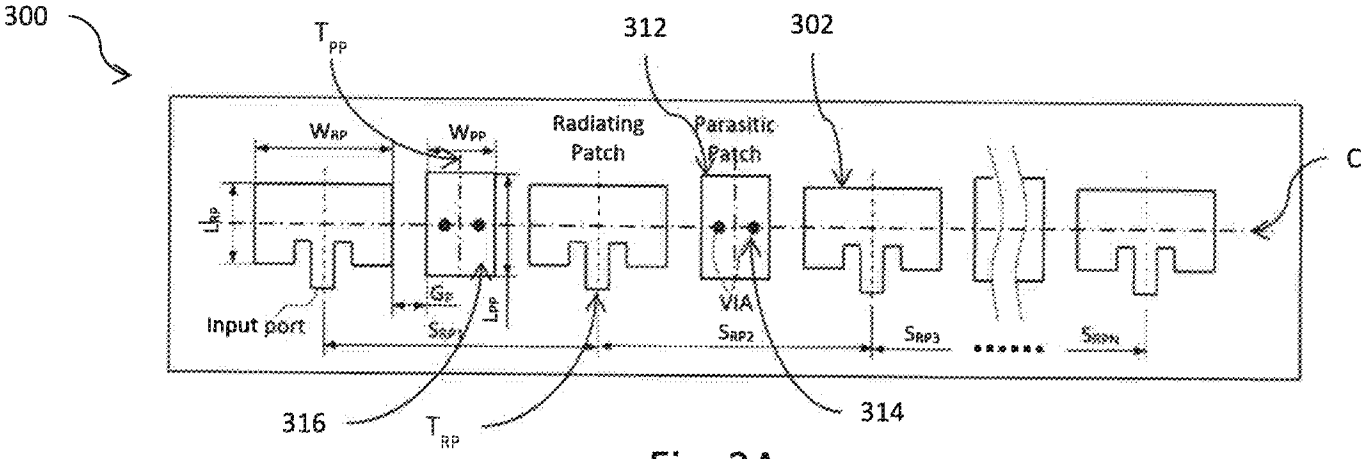
FIG. 3A is a top view of another example microstrip antenna array.
Figure 3B:
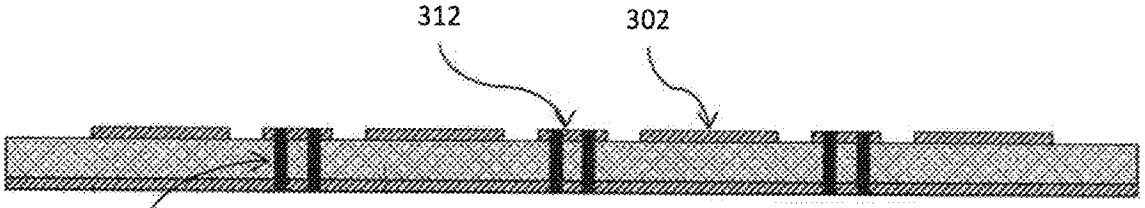
FIG. 3B is a side view of another example microstrip antenna array.

Another example of a microstrip patch antenna array 300 is shown in FIGS. 3A and 3B. The construction of the antenna array 300 is similar to that of the previous example in that the radiating patches 302 are the same and the parasitic patches 312 comprise a strip of conducting metal, each parasitic patch 312 being positioned between two radiating patches 302. That is, the length of parasitic patch $L_{PP}$ approximately is close to half wavelength in substrate $\lambda_d/2$ at central working frequency $f_0$. The width of parasitic patch $W_{PP}$ and gaps between radiating patches $G_P$ are tuned to provide the certain strength of coupling k between radiating patches.

The parasitic patches 312 shown in FIG. 4 also comprise two VIAs 314 in each patch 312. The VIAs 314 are an electrical connection between the conducting metal portion of the parasitic patch 312 and the ground plane, passing though the substrate. The VIAs 314 are positioned within the area of the conducting metal portion of the parasitic patch 312 and along the common longitudinal axis C. The VIAs 314 are placed along the parasitic patch longitudinal axis and divide the conducting metal portion of the parasitic patch 312 into two quarter wavelength $\lambda_d/4$ resonant portions 316. The quarter wavelength $\lambda_d/4$ portions 316 are coupled together through the VIAs 314. This coupling creates an additional resonance frequency $f_3$. The distance between VIAs 314 and their diameters is tuned to provide necessary coupling between the two quarter wavelength $\lambda_d/4$ resonance portions 316.

Figure 4A:
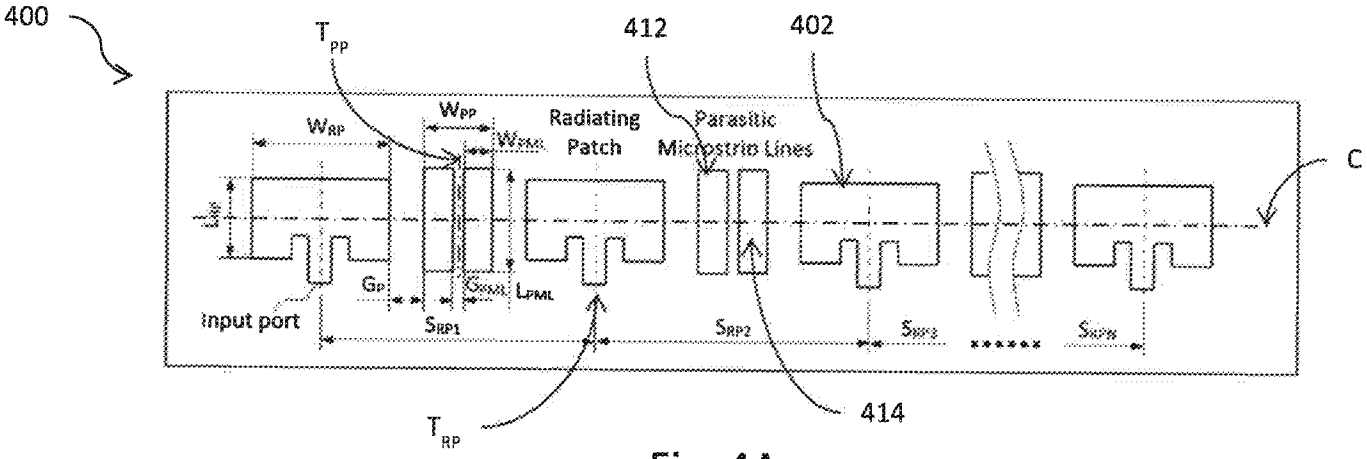
FIG. 4A is a top view of yet another example microstrip antenna array.
Figure 4B:
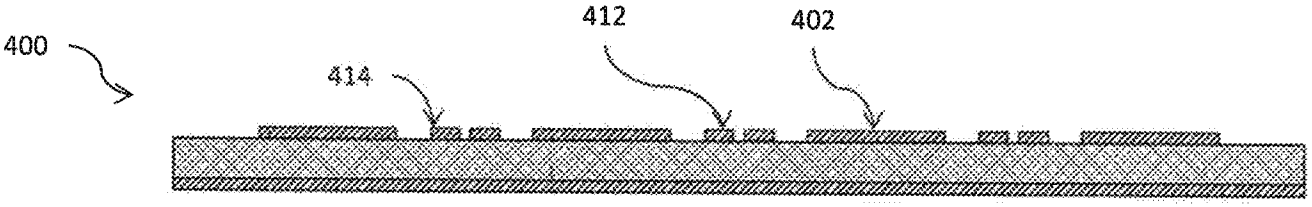
FIG. 4B is a side view of yet another example microstrip antenna array.

Yet another example of a microstrip patch antenna array 400 is shown in FIGS. 4A and 4B. In this example, the radiating patches 402 are the same as in the previous two examples. The parasitic patch 412 in this example comprises two parasitic microstrip lines 414 are placed between the radiating patches 402. The length of parasitic microstrip lines $L_{PML}$ approximately is close to a half wavelength of the signal in substrate $\lambda_d/2$ at the central working frequency $f_0$. Each parasitic microstrip line has a width $W_{PML}$. The gaps between parasitic microstrip lines and radiating patches $G_P$ are tuned to provide the certain strength of coupling k between radiating patches 402. The parasitic microstrip lines 414 are coupled together through the gap $G_{PML}$. This coupling creates an additional resonance frequency $f_3$. The gap between parasitic microstrip lines $G_{PML}$ is tuned to provide necessary coupling between them.

Figure 5:
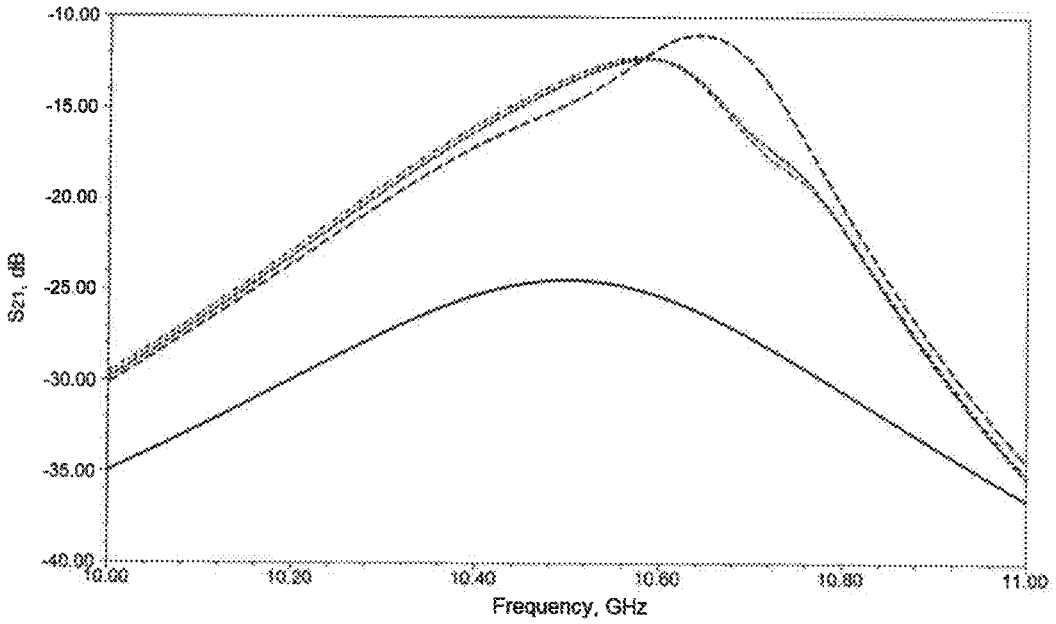
FIG. 5 shows S-parameters for the prior art antenna array and for each of the example antenna arrays.

The S-parameters for the prior art antenna array and for each of the examples are shown in FIG. 5. S-parameters characterize the mutual coupling between radiating patches, and the $S_{21}$ parameter indicates power loss or gain at the output of the system as compared to the energy put into the system.

Figure 6:
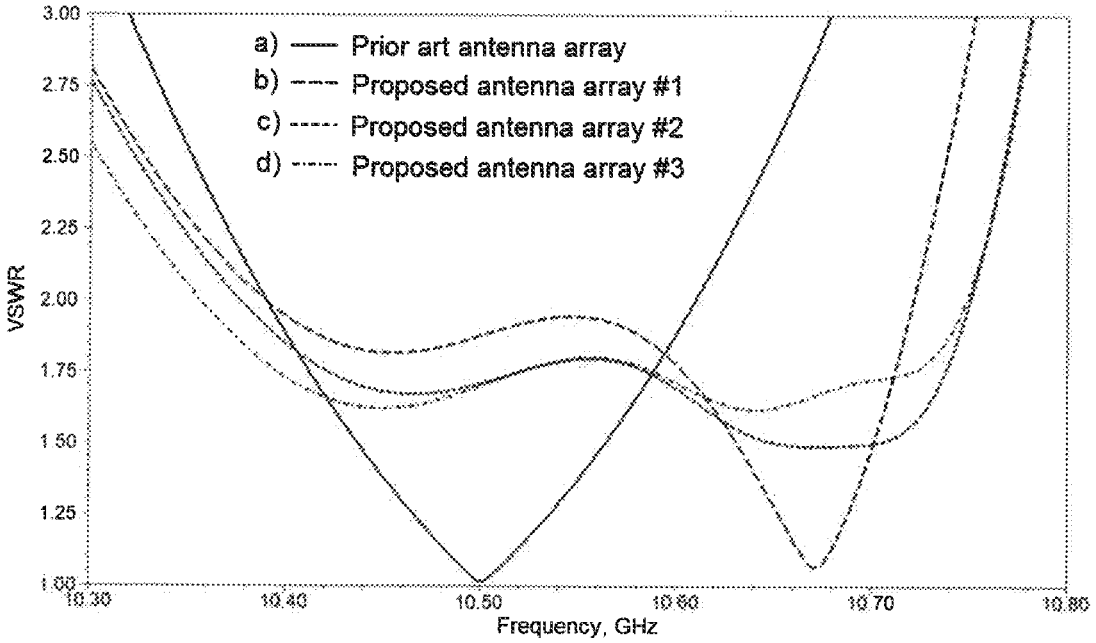
FIG. 6 shows a graph of the voltage standing wave ratio (VSWR) at the input of a radiating patch for each of the prior art and example antenna arrays.

FIG. 6 shows a graph of the voltage standing wave ratio (VSWR) at the input of a radiating patch for each of the prior art and the above example antenna arrays. At a VSWR of, 10% of the input power is reflected and this is a level at which the antenna may be considered to be impedance matched with the input feedline. At this value, it can be clearly seen from the graph that the bandwidth for each of the example patch arrays is significantly wider than that of the prior art array.

Figure 7:
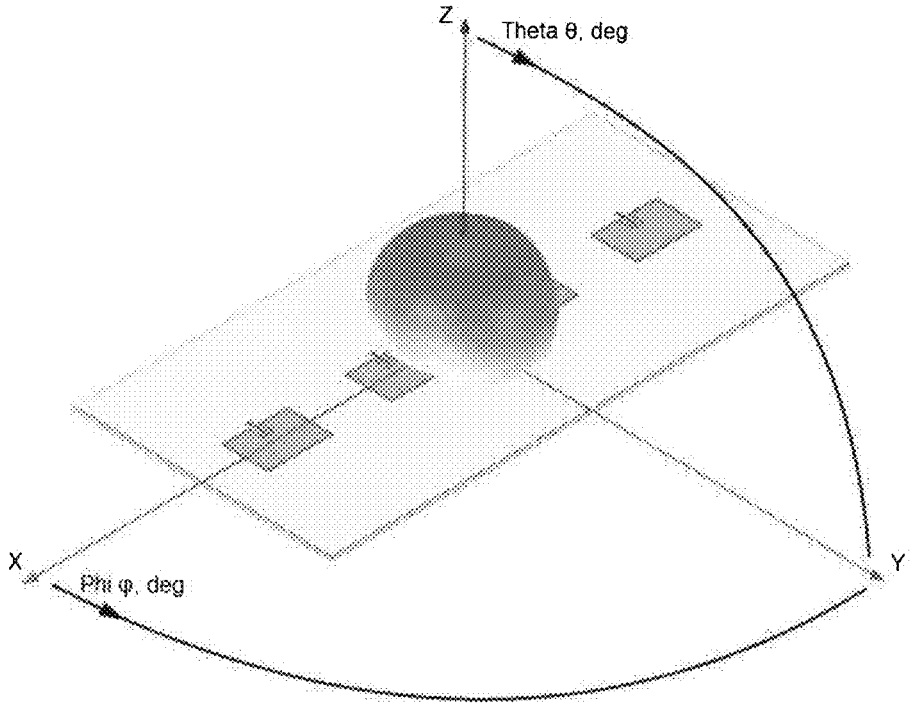
FIG. 7 shows a spherical polar coordinate system applied to a microstrip antenna array.

FIG. 7 shows a spherical polar coordinate system, where the x-axis is collinear with the common longitudinal axis, the y-axis is parallel to the transverse direction, and the z-axis is in a direction upwards from the substrate and antenna and is perpendicular to the conducting plane. The origin of the coordinate axis is at the midpoint between two radiating patches.

Figure 8A:
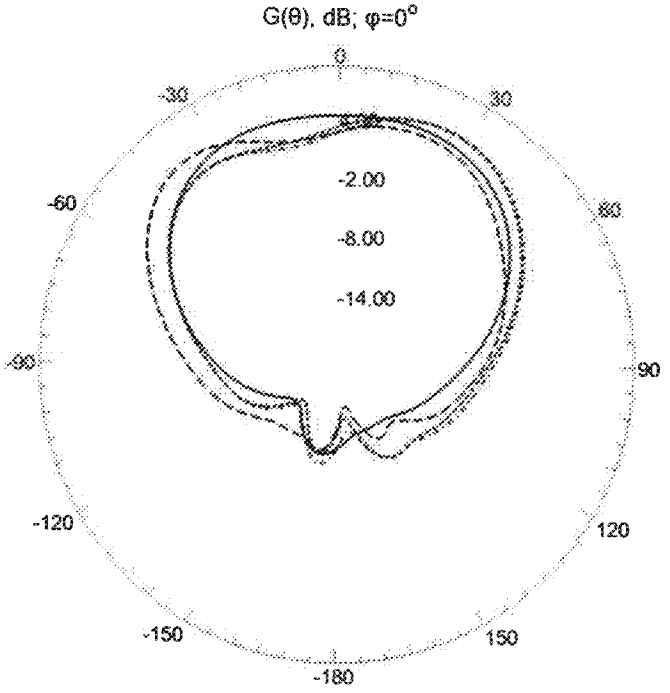
FIGS. 8A and 8B are radiation patterns of the prior art patch antenna array and for each of the example arrays at angles of $\varphi=0$ and $\varphi=90$ based upon the coordinate system shown in FIG. 7.
Figure 8B:
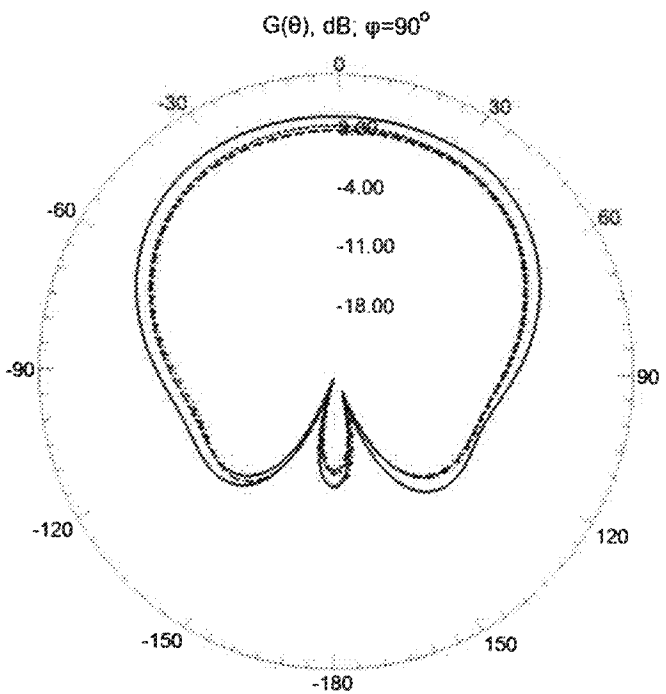

FIGS. 8A and 8B are radiation patterns of the prior art patch antenna array and for each of the example arrays at angles of $\varphi=0$ and $\varphi=90$ based upon the coordinate system shown in FIG. 7. The mutual coupling between the radiating patches and the parasitic patches causes a slight distortion of the radiating characteristic of radiating patch $G(\theta)$ and reduces the gain of the radiating patch no higher than 1.5 dB, which is appropriate for many applications.

In some embodiments two adjacent radiating patches with a parasitic patch between them may be united by a common feeding network, hence forming them into one interconnected structure. In this case the input ports of the two adjacent radiating patches can be connected together and joined to the common feeding network. The feeding network can be configured to provide a necessary amplitude and phase distribution for signals exiting the radiating patches. Such a structure alleviates a distortion of the radiating characteristic, which is caused by the mutual coupling between the radiating patches, so that there is almost no reduction in the gain (lower than 0.5 dB). With this type of antenna, with two radiating patches having a common feeding network, the parasitic patch may be any of the types described previously. This antenna may be used as a single independent antenna with increased bandwidth or as a part (subarray) of a larger antenna array, with multiple pairs of radiating patches each pair having interconnected input ports. In an antenna array consisted of such subarrays, there may be a parasitic patch between two adjacent subarrays or it may be eliminated.

What is claimed is:

1. A microstrip antenna array (200; 300; 400) comprising:
- a thin substrate (204);
- three or more microstrip radiating patches (202; 302; 402) placed on a first side (208) of the substrate (204), each radiating patch (202; 302; 402) comprising:
  - an input port (210);
  - a radiating patch width ($W_{RP}$) extending in a longitudinal direction;
  - a radiating patch length ($L_{RP}$) extending in a transverse direction, wherein the transverse direction is perpendicular to the longitudinal direction, and wherein the longitudinal and transverse directions are in the plane of the radiating patch;
- a radiating patch transverse axis ($T_{RP}$) along the midpoint of the radiating patch width; and
  - a radiating patch longitudinal axis along the midpoint of the radiating patch length,
- wherein the two three or more radiating patches are spaced in the longitudinal direction such that the radiating patch longitudinal axis of each radiating patch is aligned along a common longitudinal axis (C); and
- two or more parasitic patches (212; 312; 412) placed on the first side (208) of the substrate (204), wherein there is at least one fewer parasitic patches than there are radiating patches, each parasitic patch comprising:
  - a parasitic patch width ($W_{PP}$) extending in the longitudinal direction;
  - a parasitic patch length ($L_{PP}$) extending in the transverse direction;
  - a parasitic patch transverse axis ($T_{pp}$) along the midpoint of the parasitic patch width; and
  - a parasitic patch longitudinal axis along the midpoint of the parasitic patch length,
- wherein the two or more parasitic patches (212; 312; 412) are spaced in the longitudinal direction such that the parasitic patch longitudinal axis of each parasitic patch is aligned along the common longitudinal axis (C), wherein each parasitic patch is positioned between two radiating patches (202; 302; 402), and wherein the parasitic patch transverse axis ($T_{PP}$) of each parasitic patch is positioned at the midpoint between the radiating patch transverse axes ($T_{RP}$) of the two radiating patches either side of each parasitic patch,
- wherein the parasitic patch width and gaps between radiating patches $G_p$ are tuned to provide the certain strength of coupling k between radiating patches.

2. The array of claim 1, wherein the radiating patch input ports are positioned along the radiating patch transverse axis.

3. The array of claim 1, wherein the substrate has a thickness of 1.0 mm or less.

4. The array of claim 1, wherein the radiating patches are regularly spaced along the common longitudinal axis.

5. The array of claim 1, wherein the radiating patch transverse axes of adjacent radiating patches are separated by about a half wavelength of an input signal, wherein the wavelength of the signal is modified by the substrate.

6. The array of claim 1, wherein the parasitic patch length is about a half wavelength of an input signal, wherein the wavelength of the signal is modified by the substrate.

7. The array of claim 1, wherein at least one of the two or more parasitic patches is symmetric about the common longitudinal axis.

8. The array of claim 1, wherein at least one of the two or more parasitic patches is symmetric about its parasitic patch transverse axis.

9. The array of claim 1, wherein at least one of the three or more radiating patches is symmetric about its radiating patch transverse axis.

10. The array of claim 1, wherein at least one parasitic patch comprises at least one VIA.

11. The array of claim 10, wherein the VIA is positioned along the common longitudinal axis.

12. The array of claim 10, wherein the VIAs are positioned to divide the parasitic patch into two quarter wavelength $\lambda_d/4$ resonant portions.

13. The array of claim 1, wherein one of the parasitic patches comprises two or more parasitic microstrip lines, the lines being spaced apart along the common longitudinal axis and between two radiating patches.

14. The array of claim 13, wherein the gap between the two or more parasitic microstrip lines is tuned to provide necessary coupling between them.

* * * * *